US009200489B1

(12) United States Patent
Mabry

(10) Patent No.: US 9,200,489 B1
(45) Date of Patent: Dec. 1, 2015

(54) SUCKER ROD GUIDE

(71) Applicant: Master Kraft Tooling Corporation, Tulsa, OK (US)

(72) Inventor: John F. Mabry, Owasso, OK (US)

(73) Assignee: Master Kraft Tooling Corporation, Tulsa, OK (US)

( * ) Notice: Subject to any disclaimer, the term of this patent is extended or adjusted under 35 U.S.C. 154(b) by 100 days.

(21) Appl. No.: 13/964,942

(22) Filed: Aug. 12, 2013

(51) Int. Cl.
*E21B 17/10* (2006.01)

(52) U.S. Cl.
CPC ..... *E21B 17/1071* (2013.01)

(58) Field of Classification Search
CPC ..... E21B 17/1071
See application file for complete search history.

(56) References Cited

U.S. PATENT DOCUMENTS

| | | | | |
|---|---|---|---|---|
| 2,153,787 | A | 7/1937 | Anderson | |
| 3,058,524 | A | 9/1959 | Tripplehorn | |
| 3,282,345 | A * | 11/1966 | Tripplehorn | 166/176 |
| 4,589,483 | A | 5/1986 | Sable | |
| 4,995,459 | A * | 2/1991 | Mabry | 166/176 |
| 6,808,019 | B1 | 10/2004 | Mabry | |
| 2006/0201670 | A1 * | 9/2006 | Stewart | 166/241.6 |

* cited by examiner

*Primary Examiner* — William P Neuder
(74) *Attorney, Agent, or Firm* — Frank J. Catalano; Gable Gotwals

(57) ABSTRACT

An oil well sucker rod guide protects the rods and production tubing from frictional wear during the vertical reciprocation pumping action. The guide has a sleeve enveloping the sucker rod with raised ribs contacting the tubing in an opposed fashion. The raised ribs are circumferentially sequenced to contact the entire circumference of the tubing and provide oil flow-through passages between the sleeve and the tubing. The raised ribs have side and inside end walls angled and contoured to increase through-put of oil in the tubing.

5 Claims, 5 Drawing Sheets

SUCKER ROD GUIDE

BACKGROUND OF THE INVENTION

This invention relates generally to well production technology and more particularly concerns guides used to center sucker rods in well production tubing and to remove paraffin from the inner surface of the tubing.

Oil wells typically have a depth in a range of several hundred to several thousand feet. Sucker rods, each 25' to 30' long and ⅝" to 1⅛" inches in diameter, are linked together inside production tubing with a 2" to 3" inches inside diameter between an above-ground reciprocating jack and a bottom hole pump.

Deviation of the well components from vertical is a well-recognized problem. The production tubing axial alignment is going to deviate from vertical over its depth and the greater the well depth the more likely and more serious the deviation. The sucker rod string axial alignment is going to deviate from vertical between the jack and the pump because the pump reciprocation is delayed in comparison to the jack reciprocation. Whatever the cause, the deviation renders the rods, the rod couplings and the production tubing vulnerable to metal-to-metal frictional wear during well operation. Centering the sucker rods in the production tubing reduces such frictional wear.

Congealing paraffin is another well-recognized problem. In many oil wells, paraffin that remains mixed with warm-hot crude oil congeals as the oil cools while rising to the surface. The congealed paraffin coats the rods and the tubing and clogs the product flow paths. Removal of paraffin from the tubing wall increases the throughput of product from the well.

Sucker rod guides been devised for centering sucker rods inside their tubing and acting as a bushing to smooth out the pumping action. Some of these guides also serve the added purpose of scraping the tubing wall to break clogs and maintain acceptable rates of flow of product from the well. Some are made of plastic suitable to withstand hostile well conditions including high temperatures, harsh chemicals, sand or particulates, and even electrolysis. The problem with known sucker rod guides is that one of their primary purposes, maintaining high productivity, is often compromised in deference to another primary purpose, long-term operation.

As an example, if a guide does not adequately scrape the paraffin from the tubing, the tubing will eventually clog and reduce or cease production. In order to achieve adequate long term scraping, more and/or wider radial ribs are incorporated in the guide so as to increase its scraping circumference on the tubing. But incorporation of more and/or wider ribs structurally decreases the cross-sectional area of the product flow paths, reducing productivity. Thus, the benefit of increased production gained by better scraping is offset by lost production due to structurally constricted flow.

In another example, if a guide does not grip its rod securely enough to prevent it from sliding on its rod, its scraping benefit is sooner or later diminished or lost. In order to maintain longer grip security, the guide length is generally increased to increase its rod gripping surface. But a longer guide increases the drag on product flow through the guide, reducing productivity. Thus the benefit of increased production gained by longer connection between the guide and the rod is offset, once again by lost production due to structurally constricted flow.

It is, therefore, a primary object of this invention to provide a sucker rod guide which assists in maintaining an acceptable, long-term rate of product flow in a well production tubing.

It is also an object of this invention to provide a sucker rod guide which simultaneously affords a higher tubing contact area and a higher flow cross-sectional area than known guides.

It is another object of this invention to provide a sucker rod guide which simultaneously affords a higher flow cross-sectional area to guide length ratio than known guides.

BRIEF SUMMARY OF THE INVENTION

In accordance with the invention, guides for sucker rods reciprocating in a well production tubing are provided which will be attached at spaced intervals to the rod and extend diametrically from the rod to the production tubing. The guides are made of plastic material suitable to withstand the environmental and operational conditions in which they will be used.

The guide has a cylindrical sleeve with a lengthwise concentric passage and a plurality of ribs extending radially outwardly from the sleeve. Each of the ribs has a circumferential outer surface and their surfaces, taken together, define a common cylinder. Thus, in a single vertical stroke of the guide, the ribs have a 360° capability of contacting the surface of the inner wall of the production tubing. The outer circumference of the common cylinder defined by the outer circumferential surfaces of the ribs is so substantially congruent with the inner circumference of the production tubing during operation as to provide suitable frictional contact to remove paraffin over 360° of the inner wall of the production tubing during continuous pumping operation. The ribs also have sidewalls contoured to co-operate with the sleeve and the production tubing to define flow paths for passage of well product between the sleeve and the production tubing during reciprocation of the guide in the production tubing. At least one of the ribs has interior end walls inclined at an acute reverse angle, thereby increasing product throughput without decreasing available rib surface contact area with the production tubing.

In a preferred embodiment, the ribs define reversing symmetric product flow paths. A first pair of lengthwise ribs symmetrically spaced at an obtuse angle from a diametric plane of the sleeve extend radially outwardly from one end portion of the sleeve. A second pair of lengthwise ribs centered on the diametric plane extend radially outwardly in opposite directions from a middle portion of the sleeve. A third pair of lengthwise ribs symmetrically spaced at the same obtuse angle as the first but oppositely from the diametric plane as the first extend radially outwardly from the other end portion of the sleeve. The first, second and third pairs of ribs have circumferential outer surfaces defining a common cylinder. Thus, in a single vertical stroke of the guide, the ribs have a 360° capability of contacting the surface of the inner wall of the production tubing. The outer circumference of the common cylinder defined by the outer circumferential surfaces of the ribs is so substantially congruent with the inner circumference of the production tubing during operation as to provide suitable frictional contact to remove paraffin over 360° of the inner wall of the production tubing during continuous pumping operation. All of the ribs have sidewalls co-operable to define reversing symmetric product flow paths for passage of well product between the sleeve and the production tubing during reciprocation of the guide in the production tubing. Each of the ribs of the first and third pairs have inner end walls inclined at an acute reverse angle, thereby increasing product throughput without decreasing available rib surface contact area with the production tubing. The outermost portions of the sleeve and the first and third pairs of ribs may be tapered toward the sleeve passage to streamline the flow paths.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

Figure 12:
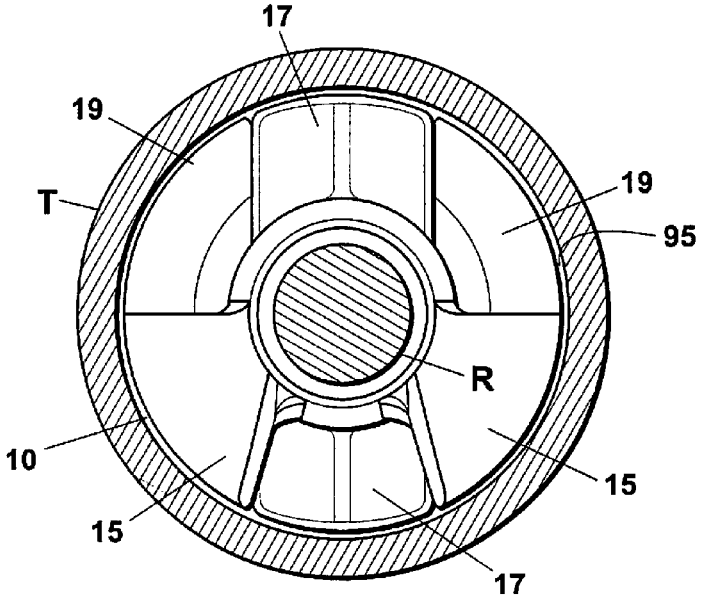
FIG. 12 is an end elevation view of the sucker rod guide of FIG. 1 on a sucker rod in a production tubing.

In FIGS. 1-12, a preferred embodiment of an improved sucker rod guide 10 is illustrated. As best seen in FIG. 12, the guides 10 will be mounted at spaced intervals on and reciprocate with sucker rods R strung in a well production tubing T.

Figure 1:
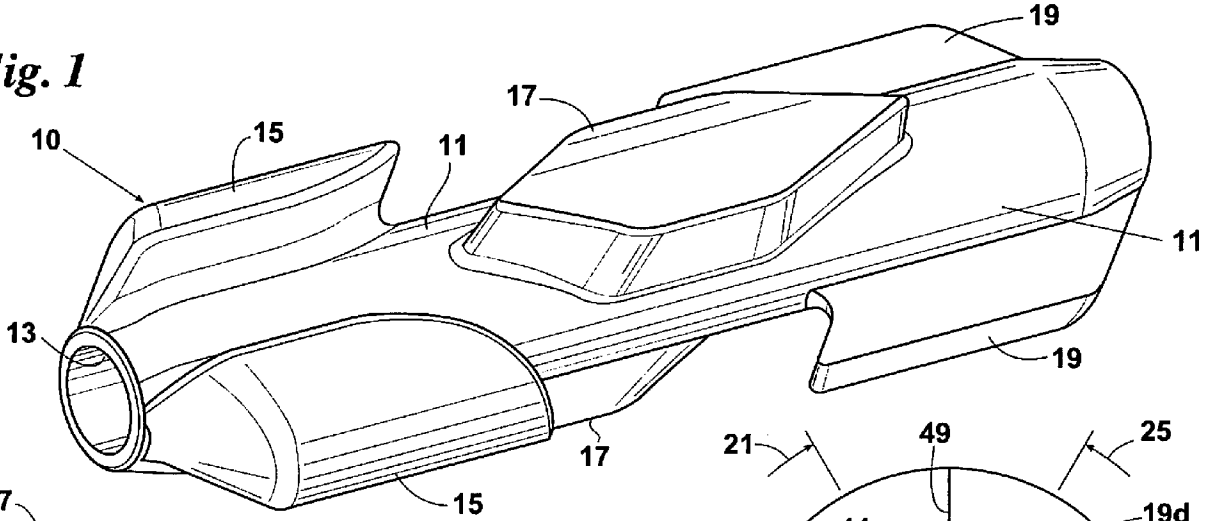
FIG. 1 is a perspective view of a sucker rod guide according to the invention.
Figure 2:
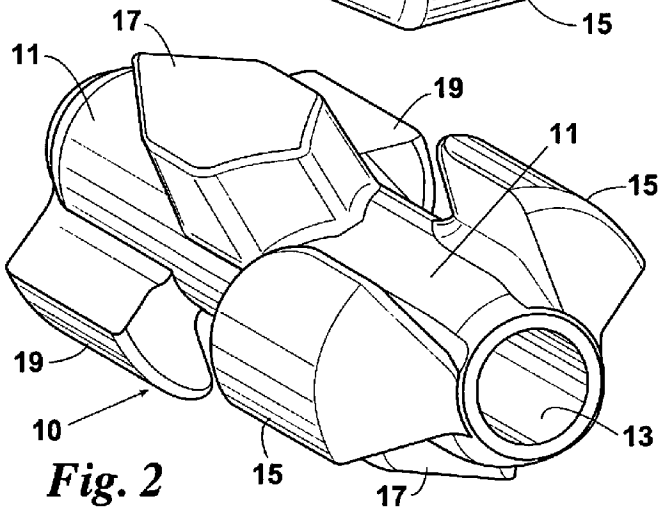
FIG. 2 is another perspective view of the sucker rod guide of FIG. 1.

Looking first at FIGS. 1 and 2, each guide 10 has a cylindrical sleeve 11 with a lengthwise concentric passage 13 in which the sucker rod R will be gripped and a plurality of ribs 15, 17 and 19 which are arranged in pairs and extend radially outwardly from the sleeve 11.

As best seen in FIGS. 3, 6, 7 and 9, two ribs $\mathbf{15}_a$ and $\mathbf{15}_c$ are on one end portion of the sleeve 11, two ribs $\mathbf{17}_b$ and $\mathbf{17}_e$ are on a center portion of the sleeve 11 and two ribs $\mathbf{19}_d$ and $\mathbf{19}_f$ are on the other end portion of the sleeve 11.

Figure 8:
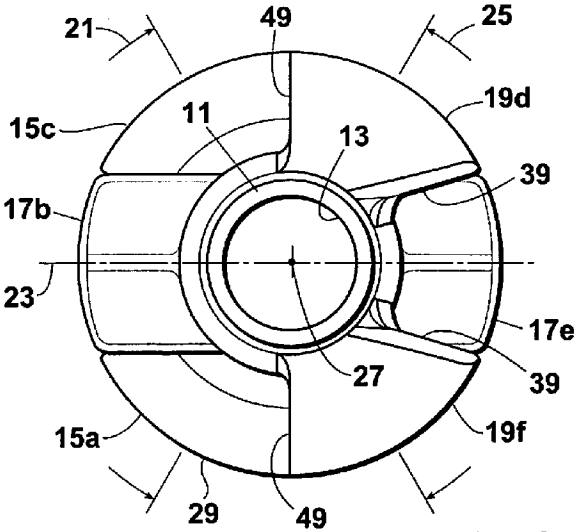
FIG. 8 is an end elevation view of the sucker rod guide of FIG. 1 taken in the direction 8-8 of FIG. 3.
Figure 4:
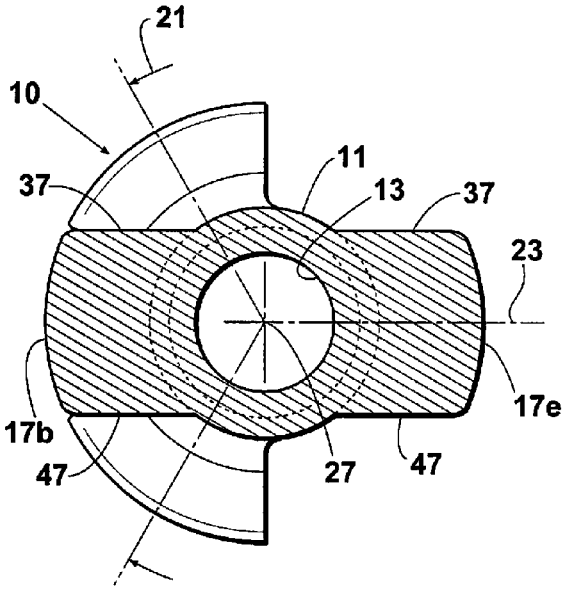
FIG. 4 is a cross-sectional view taken along the line 4-4 of FIG. 3.
Figure 5:
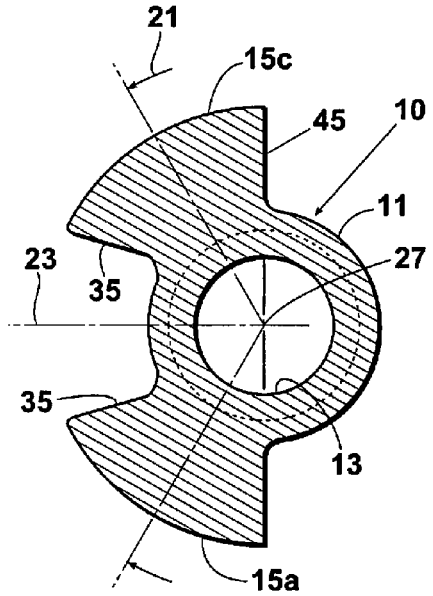
FIG. 5 is a cross-sectional view taken along the line 5-5 of FIG. 3.

As best seen in FIGS. 4, 5 and 8, the one end portion ribs $\mathbf{15}_a$ and $\mathbf{15}_c$ are symmetrically spaced at an obtuse angle 21 bisected by a diametric plane 23 taken through the sleeve 11, the center portion ribs $\mathbf{17}_b$ and $\mathbf{17}_c$ are symmetrically oppositely spaced on the diametric plane 23 and the other end portion ribs $\mathbf{19}_d$ and $\mathbf{19}_f$ are symmetrically spaced at an obtuse angle 25 bisected by the diametric plane 23 but on the opposite side of the sleeve longitudinal axis 27 than the one end portion ribs $\mathbf{15}_a$ and $\mathbf{15}_c$.

As best seen in FIG. 8, in a clockwise direction around the longitudinal axis 21 of the sleeve 11, the ribs appear sequentially as $\mathbf{15}_a$, $\mathbf{17}_b$, $\mathbf{15}_c$, $\mathbf{19}_d$, $\mathbf{17}_e$ and $\mathbf{19}_f$. The outer circumferential surfaces of the ribs $\mathbf{15}_a$ and $\mathbf{15}_c$, $\mathbf{17}_b$ and $\mathbf{17}_c$ and $\mathbf{19}_d$ and $\mathbf{19}_f$, taken together, define a common cylinder 29. Thus, in a single vertical stroke of the guide 10, the ribs $\mathbf{15}_a$, $\mathbf{17}_b$, $\mathbf{15}_c$, $\mathbf{19}_d$, $\mathbf{17}_e$ and $\mathbf{19}_f$ have a 360° capability of contacting the surface of the inner wall of the production tubing T.

This 360° capability may, however, not be achieved in any given stroke of the sucker rod string. Neither the production tubing T nor the sucker rod string are independently likely to be axially perfectly straight or together in perfect alignment. Furthermore, in order to minimize the likelihood of creation of back-pressure in the tubing T, the guide 10 must in any event be slightly less in diameter than the inner diameter of the tubing T. Therefore, like known sucker rod guides, the present sucker rod guides 10 are typically ⅛" to 3/16" in diameter less than the inner diameters of their tubing T, which ranges between 2" and 3". As with known guides, the sucker rod strings are incrementally rotated in the tubing T from stroke-to-stroke during operation so that the entire circumference of the guide 10 has the opportunity of contacting the entire circumference of the tubing T.

In this context, it can be said that the outer circumference of the common cylinder 29 defined by the outer circumferential surfaces of the ribs $\mathbf{15}_c$, $\mathbf{17}_b$, $\mathbf{15}_c$, $\mathbf{19}_d$, $\mathbf{17}_c$ and $\mathbf{19}_f$ is so substantially congruent with the inner circumference of the production tubing T during operation as to provide suitable frictional contact to remove paraffin over 360° of the inner wall of the production tubing T during continuous pumping operation.

Figure 3:
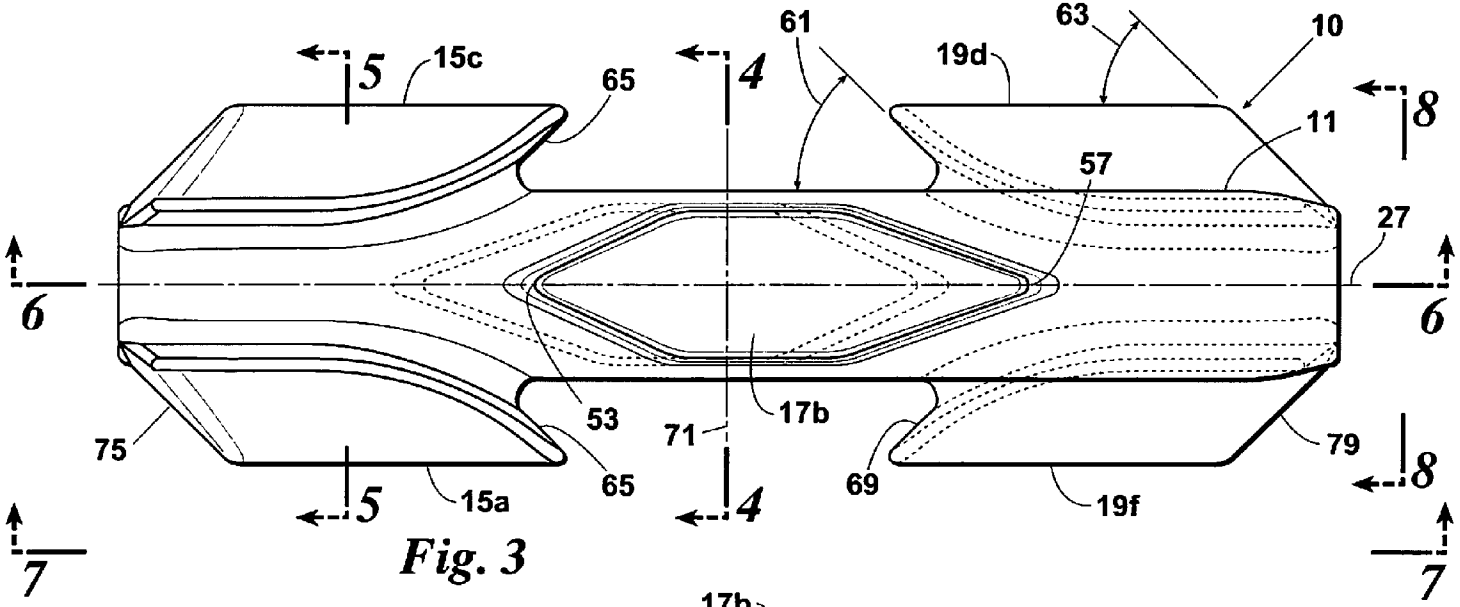
FIG. 3 is a first elevation view of the sucker rod guide of FIG. 1.
Figure 6:
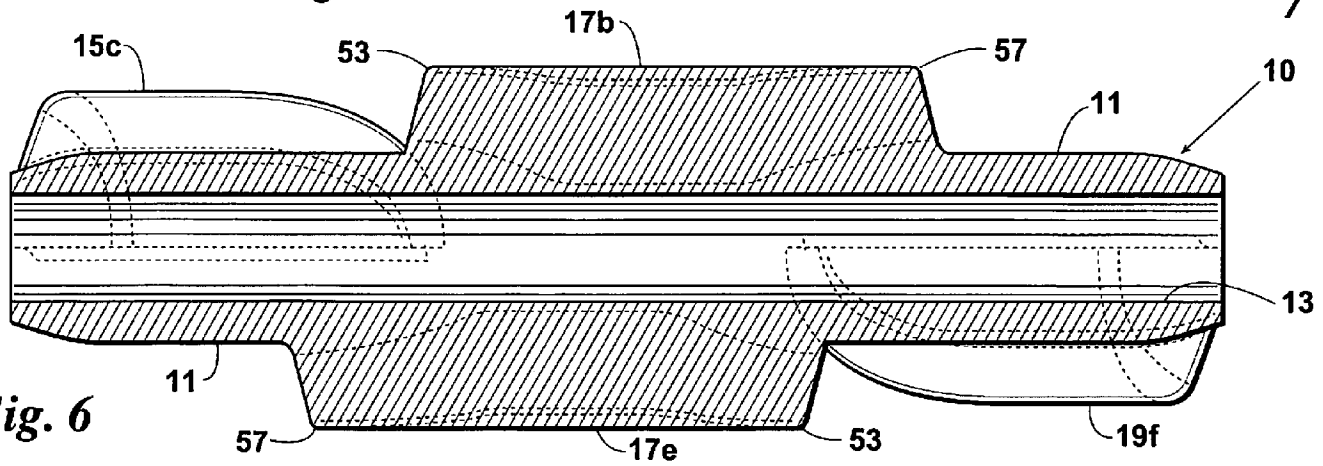
FIG. 6 is a cross-sectional view taken along the line 6-6 of FIG. 3.
Figure 9:
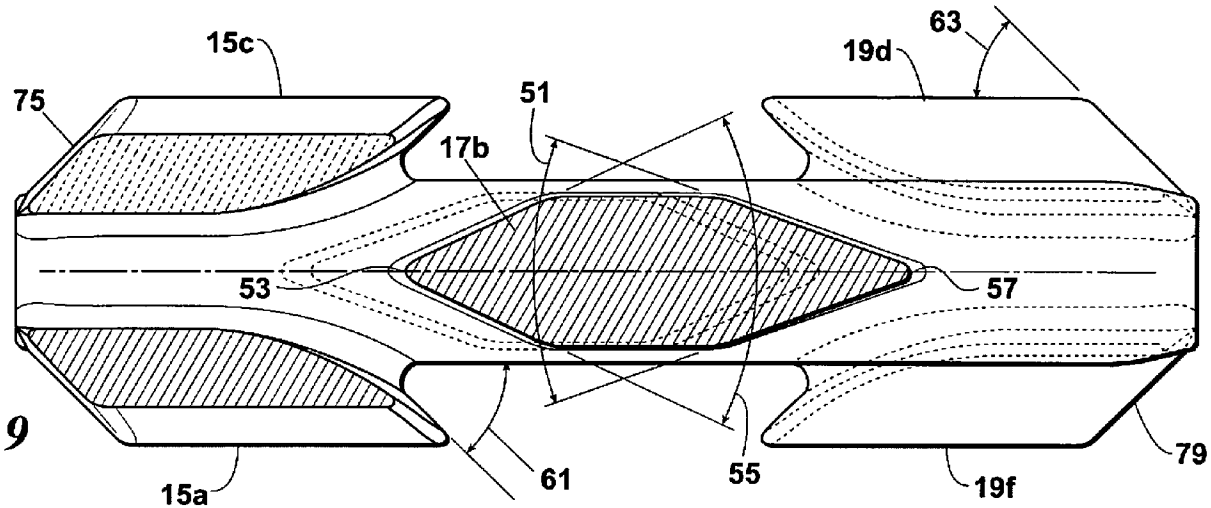
FIG. 9 is a cross-sectional view taken along the line 9-9 of FIG. 7.
Figure 7:
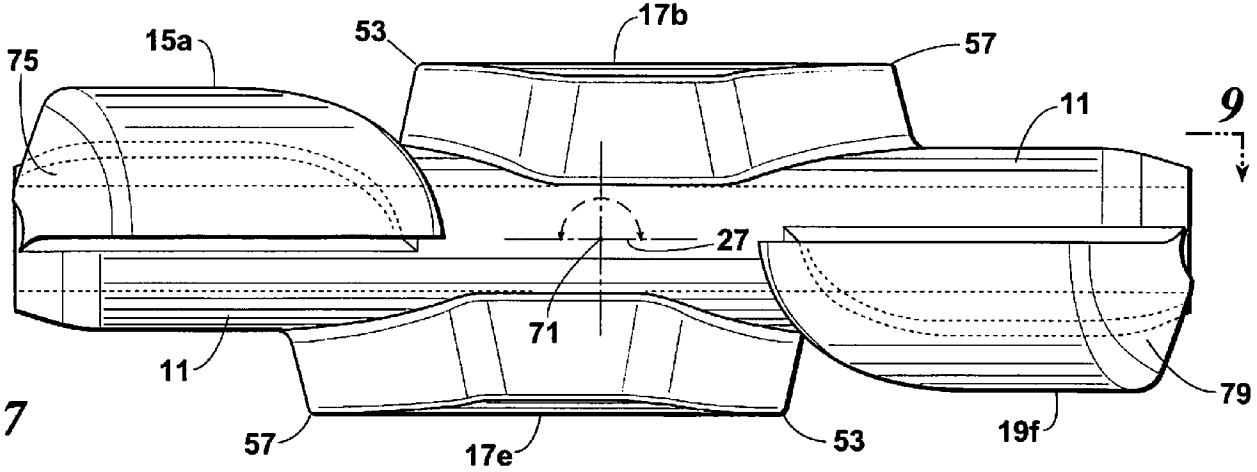
FIG. 7 is a second elevation view of the sucker rod guide of FIG. 1 taken orthogonally in relation to FIG. 3.

Looking at FIGS. 4, 5 and 8, the ribs 15 and 19 have proximal non-radial sidewalls 35 and 39, respectively, and distal radial sidewalls 45 and 49, respectively, and the ribs 17 have parallel opposed chordal sidewalls 37 and 47. Looking at FIGS. 3, 6, 7 and 9, the ribs 17 on the center portion of the guide 10 are lengthwise offset and are at least wide enough to contact those circumferential portions of the production tubing T not contacted by the end portion ribs 15 and 19. They are also inverted with their ends tapered at different angles toward their respective ends of the guide 10. The angle of convergence 51 of their innermost ends 53 is greater than the angle of convergence 55 of their outermost ends 57. As shown, the greater angle of convergence 51 is 50° and the smaller angle of convergence 53 is 40°. The end portion ribs 15 and 19 have interior end walls 65 and 69, respectively, inclined at an acute reverse angle 61, thereby increasing product throughput without decreasing rib surface contact with the production tubing T. As best seen in FIGS. 3 and 9, the convergence angles 51 and 55 of the center portion ribs 17 and the contours of the junction zones of the proximal sidewalls 35 and 39 of the end portion ribs 15 and 19 with their interior end walls 65 and 69, respectively, cooperate to streamline flow between their opposed surfaces and through the guide 10. The outermost ends 75 and 79 of the ribs 15 and 19 are also tapered, as shown parallel to their respective interior end walls 65 and 69. As herein described and best understood in reference to FIGS. 3 and 6, the guide 10 is symmetric about an end-to-end rotation axis 71, so the guide 10 can be mounted on a sucker rod R with either end of the guide 10 up.

Figure 10:
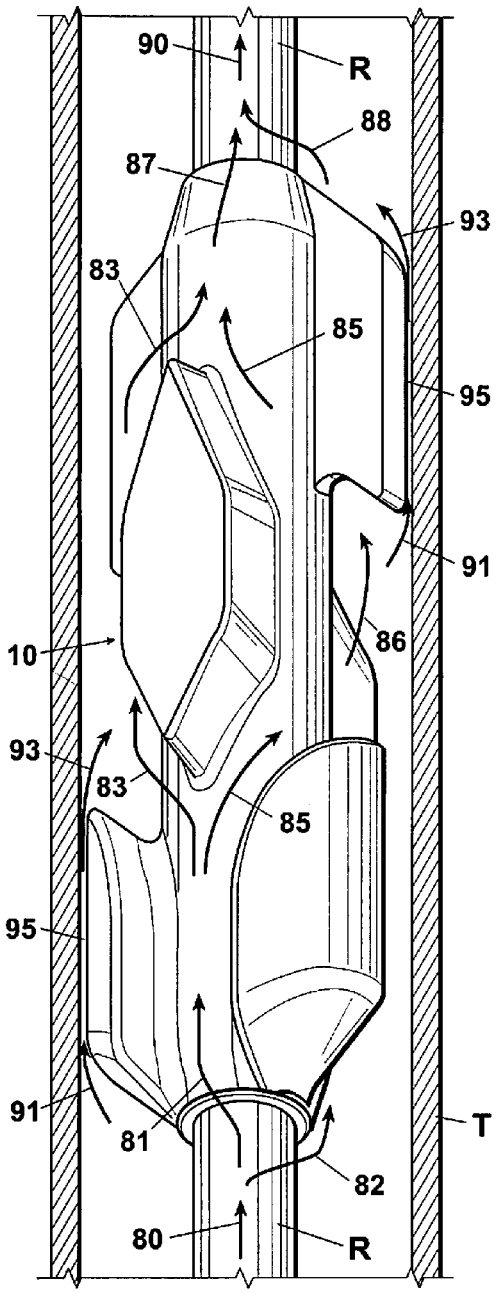
FIG. 10 is a perspective view of the sucker rod guide of FIG. 1 in a first orientation illustrating product flow paths through the guide during its down stroke in a well production tubing.
Figure 11:
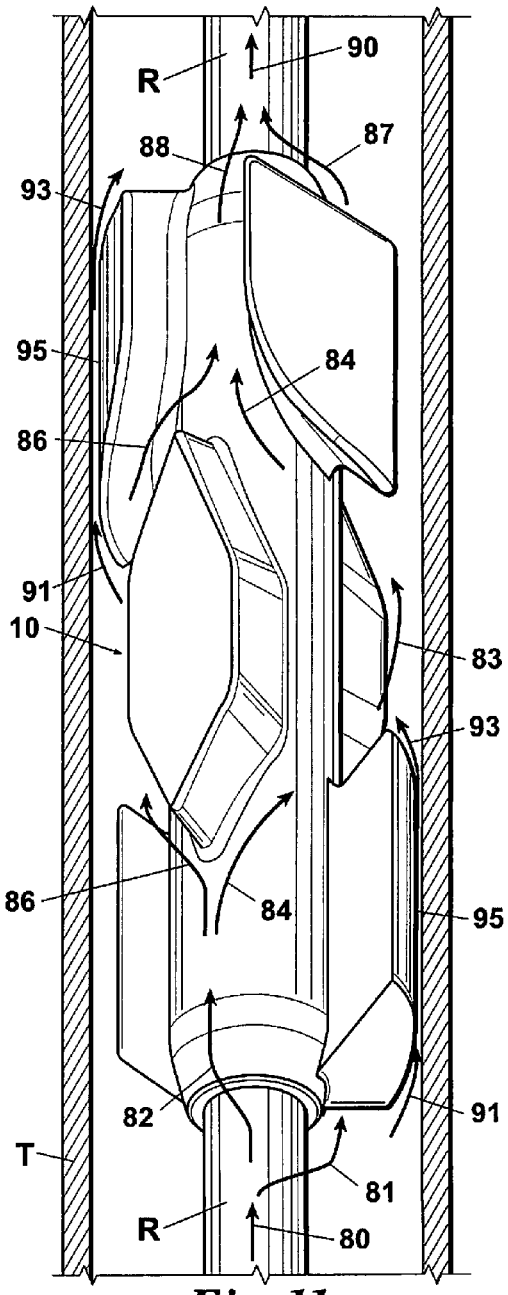
FIG. 11 is a perspective view of the sucker rod guide of FIG. 1 in a second orientation rotated 180° from the orientation of FIG. 10 illustrating product flow paths through the guide during its down stroke in a well production tubing.

Looking at FIGS. 10-12, the flow paths defined by the sleeve 11 and ribs 15, 17 and 19 of the guide 10 and the inner wall of the production tubing T during the process of artificial lift can be understood. During the upstroke, the oil column 80 moves up the tubing T with the guide 10 a distance equal to the stroke of the pump jack (not shown). The lifted oil stays in that position during the down stroke. Oil does not flow around the guide 10 during the upstroke. During the down stroke, the guide 10 attacks and moves through the oil column 80, gathering another quantity of crude equal to the stroke. The guide 10 passes through the column of oil 80, splitting it initially into two main columns 81 and 82 which are further each split into two secondary columns 83 and 85 and 84 and 86 which are then converged into two columns 87 and 89 and back to one column 90 at the upper end of the guide 10. A number of smaller splits 91 and convergences 93 occur at the leading edges of the ribs 15, 17 and 19 which are slightly spaced 95 from the inner wall of the tubing T, as best seen in FIG. 12, so the oil does flow around the guide 10 during the down stroke. The flow paths 91 and 93 relieve the back pressure which can otherwise be great enough to slow the reciprocating action of the lifting process. Each upstroke adds to the volume of the lifted oil column 90 until the lifted oil reaches the surface. The guide 10 serves mainly as a bushing or centralizer of the rod R in the tubing T and also provides the ribs 15, 17 and 19 as a sacrificial material for scraping the tubing T. The guide functions as a bushing or centralizer on both the upstroke and the down stroke, helping to prevent metal to metal contact of the rods R, couplings (not shown) and tubing T.

The guides 10 are made of plastic material chosen to withstand the environmental and operational conditions in which they will be used. They are molded to surround portions of the sucker rod R and substantially, within the constraints of accounting for axial misalignment and minimizing likelihood of back-pressure in the tubing T, fill the space between the surrounded portion of the rod R and the production tubing. Each guide 10 is a full circumference bushing and scrapes the full inner circumference of the production tubing T as the rods R reciprocate in the well. The angles and radii of the guide flow paths are streamlined to enhance the overall anti-turbulence or fluid dynamics of the guide 10. Anti-turbulence surface materials may further enhance the guide's flow-through performance.

Thus, it is apparent that there has been provided, in accordance with the invention, a sucker rod guide that fully satisfies the objects, aims and advantages set forth above. While the invention has been described in connection with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A guide for a sucker rod reciprocating in a well production tubing, the guide comprising:

a cylindrical sleeve having a lengthwise concentric passage therethrough; and a plurality of ribs extending radially outwardly from said sleeve, each of said plurality of ribs having a circumferential outer surface, said surfaces taken together defining a common cylinder substantially congruent with an inner circumference of the production tubing, and having sidewalls co-operable with said sleeve and the production tubing to define flow paths for passage of well product between said sleeve and the production tubing during reciprocation of the guide in the production tubing;

at least one of said ribs having interior end walls inclined at an acute reverse angle to increase a rate a flow of the well product through the guide.

2. A guide for a sucker rod reciprocating in a well production tubing, the guide comprising:

a cylindrical sleeve having a lengthwise concentric passage;

a first pair of lengthwise ribs symmetrically spaced at an obtuse angle from a diametric plane of said sleeve and extending radially outwardly from one end portion of said sleeve;

a second pair of lengthwise ribs centered on said diametric plane and extending radially outwardly in opposite directions from a middle portion of said sleeve; and a third pair of lengthwise ribs symmetrically spaced at said obtuse angle but oppositely from said diametric plane as said first pair and extending radially outwardly from another end portion of said sleeve;

said first, second and third pairs of ribs having circumferential outer surfaces defining a common cylinder substantially congruent with an inner circumference of the production tubing; and each of said ribs having sidewalls co-operable to define symmetrically reversed flow paths for passage of well product between said sleeve and the production tubing during reciprocation of the guide in the production tubing.

3. A guide according to claim 2, each of said ribs of said first and third pairs having inner end walls inclined at an acute reverse angle to increase a rate of flow of the well product through the guide.

4. A guide according to claim 3, each of said ribs of said second pair having an end tapered toward a proximal one of said first and third pairs of ribs to streamline flow of well product therebetween.

5. A guide according to claim 4, outermost portions of said sleeve and said first and third pairs of ribs being tapered toward said sleeve passage to streamline said flow paths.

* * * * *